US005624247A

United States Patent [19]

Nakamura

[11] Patent Number: 5,624,247

[45] Date of Patent: Apr. 29, 1997

[54] BALANCE TYPE SCROLL FLUID MACHINE

[76] Inventor: Mitsuo Nakamura, 303, Banfuriito-Neyagawa, 47-1, Shimizucho, Neyagawa, Osaka 572, Japan

[21] Appl. No.: 491,191

[22] Filed: Jun. 15, 1995

[30] Foreign Application Priority Data

Jun. 17, 1994 [JP] Japan ..... 6-169906
Aug. 11, 1994 [JP] Japan ..... 6-222382

[51] Int. Cl.[6] ..... F01C 1/04

[52] U.S. Cl. ..... 418/55.2; 418/60

[58] Field of Search ..... 418/55.1, 55.2, 418/60

[56] References Cited

U.S. PATENT DOCUMENTS

| | | | |
|---|---|---|---|
| 4,558,997 | 12/1985 | Sakata et al. . | |
| 4,677,949 | 7/1987 | Youtie . | |
| 5,098,265 | 3/1992 | Machida et al. . | |
| 5,171,140 | 12/1992 | Schäfer et al. | 418/55.2 |
| 5,304,047 | 4/1994 | Shibamoto | 418/60 |
| 5,322,426 | 6/1994 | Kolb | 418/60 |

FOREIGN PATENT DOCUMENTS

| | | |
|---|---|---|
| 0059925 | 3/1982 | European Pat. Off. . |
| 0529660 | 3/1993 | European Pat. Off. . |
| 4215513A1 | 5/1992 | Germany . |
| 4215038A1 | 5/1992 | Germany . |
| 4409343 | 9/1994 | Germany . |
| 1-273891A | 11/1989 | Japan . |
| 2-182267 | 7/1990 | Japan . |
| 2277985 | 11/1990 | Japan . |
| 220296 | 1/1925 | United Kingdom . |

*Primary Examiner*—Charles G. Freay

[57] ABSTRACT

Both ends of a circling scroll are supported by a pin crank and the eccentric shaft of the circling scroll, thus assuring a stable circling or oscillating motion of the scroll. This in turn allows the scroll tooth length to be elongated, leading to an increase in the capacity of the fluid machine. Because the eccentric shaft and the pin crank are fitted into the center boss, the pin crank can work as a shaft that supports the left end of the circling scroll. The provision of the boss allows a radial load acting on the scroll tooth to be borne at the load position, thus shortening the shaft and reducing the bearing. Because the pin crank can be mounted to the boss, a two-block parallel arrangement and two-stage arrangement can be implemented easily. Further, the construction in which the pin crank is used as a left-end supporting bearing contributes to reducing the manufacturing cost of the apparatus.

1 Claim, 16 Drawing Sheets

BALANCE TYPE SCROLL FLUID MACHINE

BACKGROUND OF THE INVENTION

1. Field of the Invention

The present invention relates to a scroll type fluid machine.

2. Description of the Related Art

A conventional scroll type fluid machine generally includes a pair of scroll members of the same shape with a certain thickness, which have clockwise- or counter-clockwise-wound scroll teeth engaged 180 degrees out of phase with each other, with one scroll member fixed and the other performing a circling, but not rotating, motion with respect to the fixed member. A fluid is drawn in between the pair of scroll teeth and its volume is progressively reduced and compressed toward the center of a space formed by the paired scroll teeth. As shown in FIG. 9, the scroll tooth is considered as consisting of a plurality of continuous semicircles. If we let R stand for the radius of a smallest semicircle R1 in the upper half of the tooth with respect to the center line, then a smallest semicircle in the lower half has a radius of 2R a second semicircle R3 in the upper half has a radius of 3R, and a second semicircle R4 in the lower half has a radius of 4R, all these semicircles formed continuous. These scroll teeth are so constructed as to engage with each other from their ends toward their centers during the compression stroke.

To allow this motion, bearings that support the scroll members are generally provided outside a scroll disk, and a pin crank mechanism to ensure the circular motion is normally mounted on an outer peripheral portion of the disk.

An example of such a conventional scroll tooth construction is described in Japan Patent Application No. Showa 64-1674.

The conventional scroll type fluid machine has the following problems. As to the shape of the scroll teeth, although the scroll teeth are formed in such a way as to allow the fluid compression up to the central portion of the scroll teeth, when we look at the machine as a compressor, it has a relatively large delivery opening at the center for the delivery pressure of 7 kgf/cm2. So, the compressed space mostly comes to communicate with the delivery opening before the compression reaches the central portion. That is, the mechanism of the central portion is not utilized effectively. Denoted **3*a* in FIG. 8** is the delivery opening.

Further, because the scroll teeth engage up to the central portion, the bearings supporting the rotation and circling motion are located outside the circling scroll disk in the direction of drive shaft end. This means that the circling scroll disk is supported by the bearing on one side only, degrading the precision of the circling motion. This makes it impossible to elongate the scroll tooth length.

Another drawback is that the bearing cannot be mounted at the position where it can efficiently receive a radial load acting on the scroll tooth that is performing the compression stroke. Because the bearing is installed outside the scroll disk, the bearing is applied a moment, which is a product of the radial load acting on the scroll tooth and the distance to the bearing mounting position. So, the bearing must have an excessively large load withstand strength considering the moment. This bearing position also poses a problem of requiring additional space in the direction of axis.

Further, to achieve a circling motion without rotating the scroll, a pin crank is commonly employed in recent years. The pin crank is usually mounted on the outer periphery of the scroll disk. Because of its mounted position, the pin crank is not free from instability caused by expansion of the circling scroll disk and the accumulated mounting dimension errors of bearing, disk and housing. One of the steps taken to solve these problems is to install a shock absorbing structure in the pin crank bearing. This structure, however, causes the circling scroll to vibrate during the circling motion. These constructions are shown in FIGS. 7 and 8.

As to the capacity increase, which is one of the major market demands, the problem of accuracy is posed by the elongated scroll tooth length. To deal with this problem, there is a conventional method which forms the circling scroll as a twin type. That is, two circling scroll teeth are formed on both sides of the center mirror disk and two fixed scrolls that engage with the circling scroll teeth are provided on the left and right side. This method can make the scroll teeth length short and therefore solve the precision problem. Because the left and right circling scroll teeth are configured symmetrical with respect to the center mirror disk, however, the imbalance in weight results in a dynamic imbalance during the circling motion. To counter this dynamic imbalance, a large balance weight must be installed. The construction of the conventional twin type is shown in FIG. 15.

Further, because this correction of dynamic imbalance requires an additional space and cost, it is not possible to increase the eccentricity, a means to effectively increase the delivery capacity, which means that the capacity increase of the twin-type scroll fluid machine is difficult.

SUMMARY OF THE INVENTION

According to one aspect of this invention for solving the above-mentioned problems, the circling scroll has a boss at the central portion that receives bearings and shafts and the fixed scroll has the central portion of its tooth formed different from that of the circling scroll to allow continuous seal of a compression chamber formed between the engaged circling and fixed scroll teeth during the circling motion.

More specifically, according to the aspect of this invention, there is provided a scroll type fluid machine comprising: a circling scroll including a circling disk and a circling scroll tooth provided on the disk, with a boss at a central portion of the circling scroll tooth, the boss being formed of a semicircle on a first side and a semicircle on a second side opposite to the first side, the semicircle on the second side having a radius equal to a radius of the semicircle on the first side plus one half of a thickness of the circling scroll tooth, the geometry of the circling scroll tooth being defined by semicircles spirally connected in series from the boss at the central portion towards an outer periphery, with succeeding semicircles having progressively increasing radii; and a fixed scroll including a fixed disk and a fixed scroll tooth on the disk, with no such a boss as is provided to the circling scroll tooth formed at a central portion thereof, the fixed scroll tooth having an internal end configured such that an internal surface thereof and an external surface of the central portion of the circling scroll tooth including the boss form a sealing line, the geometry of the fixed scroll tooth being defined by semicircles spirally connected in series from the internal end of the fixed scroll tooth towards an outer periphery, with succeeding semicircles having progressively increasing radii; wherein the circling scroll tooth and the fixed scroll tooth are combined and engaged to form compression chambers therebetween, and the circling scroll is circled such that the internal surface of the internal end of the fixed scroll tooth and the external surface of the central portion of the circling scroll tooth including the boss form the sealing line when these scrolls complete a suction stroke.

The circling scroll boss receives a crank-shaped eccentric drive shaft (5), off-centered from the drive shaft, and a bearing, and the end of the boss is closed with a wall. The end of the boss receives a bearing and a pin crank, which is off-centered from the axis of the crank-shaped drive shaft by the same eccentricity as the eccentric drive shaft (5). This construction constitutes a major means to prevent the rotation of the circling scroll itself. The other end of the pin crank is supported by a bearing in the frame to allow stable circling motion of the scroll.

The side of the circling scroll is fitted with a pin-crank-shaped eccentric shaft (15) to prevent the rotation of the circling scroll during the circling motion. The eccentric shaft (15) is supported at the other end by a bearing cover through a bearing.

Because the pin-crank fitted in the circling scroll boss is supported by the bearing in the frame, the circling scroll is supported on both sides by the bearings at the central boss.

The left and right scroll teeth are formed in different shapes, with the boss provided at the center of the circling scroll. The size of the delivery opening for a required compression ratio is almost the same as that of the conventional scroll teeth of FIG. 8, and thus poses no practical problem. To ensure a required compression ratio, this invention provides a unique sealing structure of the fixed scroll, which is detailed in the description of embodiments. Because the eccentric shaft from the drive shaft is fitted, together with the bearing, into the boss of the circling scroll, the radial load acting on the scroll tooth is directly borne by the boss efficiently, which allows the drive shaft to be formed short. The left end of the boss is mounted with a pin crank, which is off-centered from the eccentric shaft by a dimension S, as shown in FIG. 1. The pin crank is supported by a bearing in the frame and performs a function of pivot for the circling motion. The provision of the pin crank at this position means that the pin crank is not affected by the thermal expansion in the radial direction during operation and that the circling scroll is supported on both sides at the central portion. This construction eliminates the biggest drawback of the conventional scroll that the scroll tooth width cannot be increased because of its cantilever or one-side support structure, and allows the scroll tooth width to be increased to a sufficient size, making it possible to upgrade the delivery capacity of the scroll fluid machine by two or three times.

As a means to prevent vibration of the circling scroll, an eccentric shaft with the same amount of eccentricity as the pin crank is attached to the side of the circling scroll to support it at two or more points by the pin crank and this eccentric shaft and thereby prevent the rotation and unstable vibration of the circling scroll.

If in the conventional machine the pin crank is mounted only to the outer periphery of the circling scroll disk, a force acting on the eccentric drive shaft of the circling scroll that tends to rotate the circling scroll applies a large moment to the pin crank. So, it is necessary to increase the diameter of the pin crank and the bearing. With this invention, however, because the pin crank is mounted to the end of the boss, the moment applied is small and the shaft and bearing need not be increased in size.

Mounting the pin crank to the end surface of the boss makes it easy to form the scroll compression section in a two-block parallel arrangement, as shown in FIG. 2, by replacing the pin crank with a double L-shaped pin crank. With this configuration, the two blocks alternately perform the compression stroke or delivery stroke, so that the dynamic balance is completely established during the circling motion. This configuration obviates the balance weight and is suited for applications where the machine is operated at high speeds. FIG. 3 shows a two-stage configuration in which the blocks are connected in series.

According to another aspect of this invention, the circling scroll has a mirror disk installed at the center, on both sides of which are mounted left and right circling scroll teeth in a so-called twin-type configuration, with the left and right teeth set 180 degrees out of phase with each other. In other words, the left and right teeth assumes the same positions if they are turned 180 degrees about the drive shaft axis.

More specifically, according to the aspect of this invention, there is provided a balance type scroll fluid machine comprising:

a central mirror disk of a circling scroll, having two sides and mounted to circle through a bearing rotatably provided about an eccentric drive shaft, the mirror disk having scroll teeth on each of said two sides, said scroll teeth on each of said two sides having the same configuration and each of said two sides having a respective boss at a central portion, the scroll teeth on one of said two sides being positioned 180° out of phase relative to the scroll teeth on the other of said two sides about a drive shaft axis in order to achieve a weight balance therebetween; and fixed scrolls located on opposite sides of said mirror disk, each fixed scroll having scroll teeth respectively engaged with corresponding scroll teeth on an adjacent one of said two sides of the mirror disk, one of said scroll teeth of the fixed scrolls having an arcuate shape with an end located above a center point thereof (G2) which is downwardly off-centered relative to said drive shaft axis by an eccentricity which is the same as an eccentricity of the eccentric drive shaft of said mirror disk relative to said drive shaft axis, the other of said scroll teeth of the fixed scrolls also having an arcuate shape with an end located below said center point (G2), whereby the ends of said one scroll tooth and said other scroll tooth of the fixed scrolls, disposed cooperatively on said opposite sides of said mirror disk, alternately perform compression operations separated by 180°.

The circling scroll mirror disk is mounted with a plurality of pin cranks having a bearing at two or more positions along the outer periphery of the mirror disk to prevent the rotation of the circling scroll during the circling motion.

The fixed scrolls that engage with the left and right circling scroll teeth are also arranged 180 degrees out of phase with each other. That is, when the left fixed scroll just completes the suction stroke, the right fixed scroll enters the compression stroke, which is 180 degrees apart from the suction stroke.

As mentioned above, because the left and right circling scrolls are mounted on both sides of the center mirror disk with the right circling scroll located at a position rotated 180 degrees from the left circling scroll, the halves of the circling scroll divided by a line passing through the drive shaft axis G, as shown in FIG. 13, perfectly balance each other in weight. It is noted, however, that the weight correction associated with the bearing 59 must be done by forming drill holes in the boss.

As the circling scroll can be formed to be perfectly balanced, there is no need to install a balance weight. Further, in this configuration if the amount of eccentricity is increased, only the mirror disk needs to be enlarged and the halves of the scroll remains balanced in terms of weight, so that the delivery capacity can easily be increased by increasing the eccentricity without a fear of increasing vibrations. Further, because the compression is performed on one side, left or right scroll, at a time, the pulsation during compression stroke decreases to one-half the magnitude of the conventional one.

As shown in FIG. 14, if a sealing portion is formed on both sides of the mirror disk and along the outer periphery of the disk, this configuration produces the same effect as the two-block parallel arrangement of the scroll compression section. This configuration has the advantage that because the two parallel blocks alternate in performing a series of operations—suction, compression and delivery—the compression strokes on both sides are completely isolated from each other, so that two-way parallel works can be performed simultaneously, for instance, with the right block working as a compressor and the left block as a vacuum pump.

DETAILED DESCRIPTION OF PREFERRED EMBODIMENT

Figure 1:
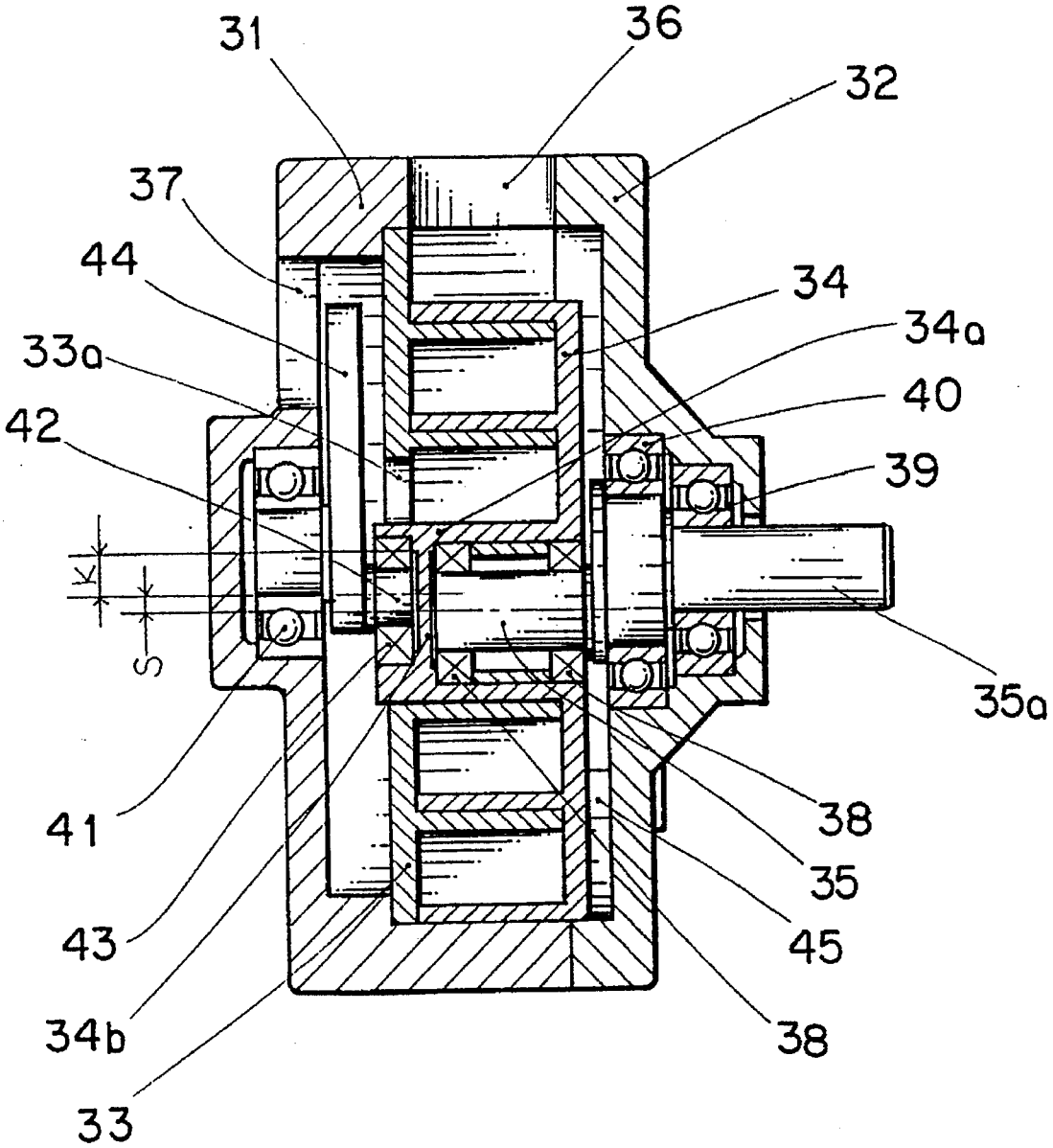
FIG. 1 is a vertical cross section of a scroll type fluid machine as one embodiment of this invention.
Figure 5:
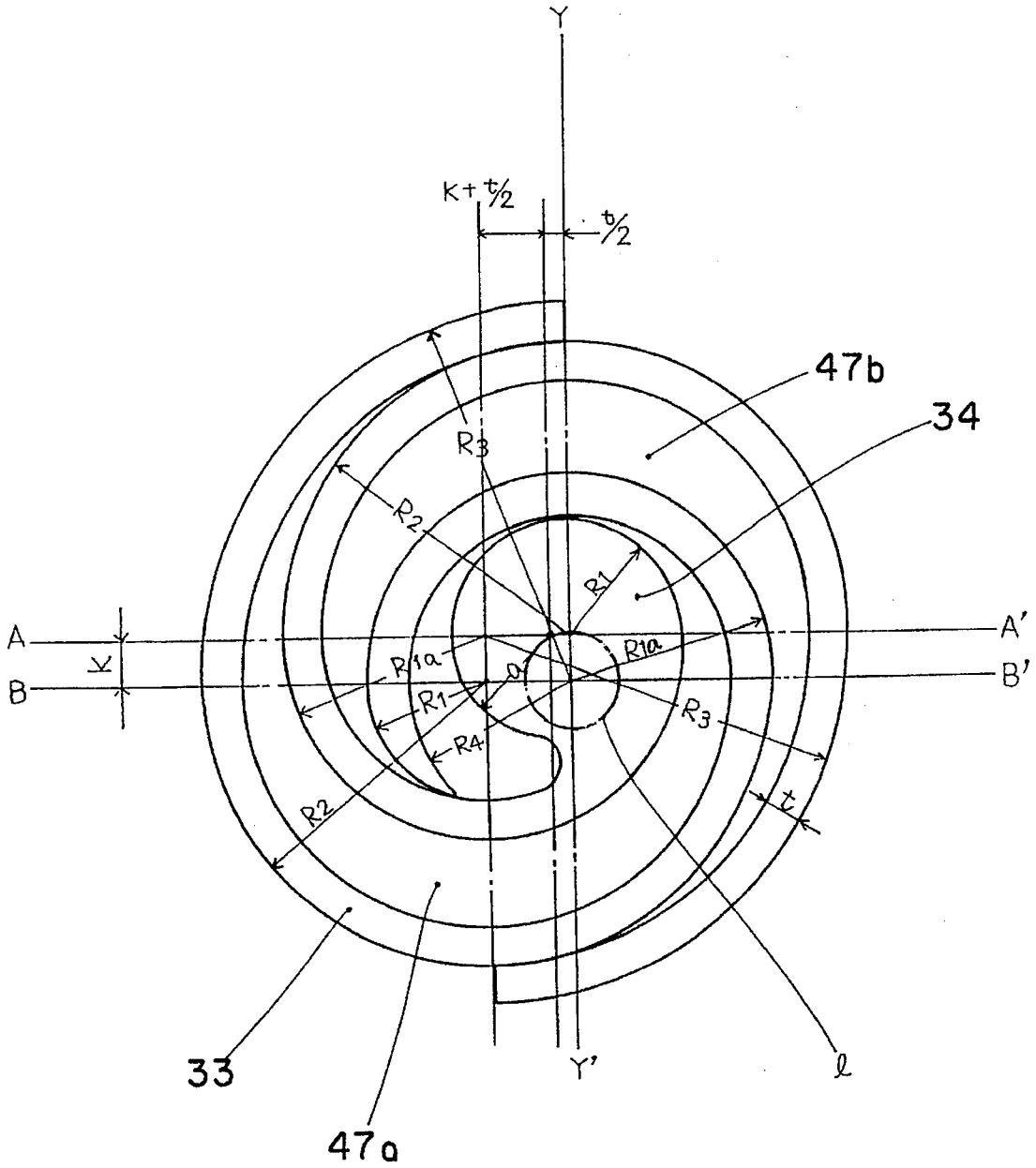
FIG. 5 is a schematic diagram showing the paired scroll teeth of this invention engaged with each other.

Embodiments of this invention will be described by referring to FIGS. 1, 5 and 6. Reference numeral 31 represents a frame, in which is installed a bearing that supports a drive eccentric shaft and the base of an eccentrically mounted pin crank. Denoted 32 is a bearing cover which accommodates bearings 39, 40 to support the drive eccentric shaft 35. Denoted 35*a* is a drive shaft. Designated 33 is a fixed scroll which is securely fixed to the frame 31. 34 signifies a circling scroll, 34*a* a circling scroll boss, 34*b* a boss wall, 36 an inlet opening, 37 a delivery opening, and 38 a boss bearing which is rotatably mounted. Designated 41 is a pin crank base bearing, 42 a pin crank, and 43 a pin crank bearing which is fitted into the circling scroll boss 34*a* with a pin crank eccentricity S. Reference number 44 signifies a balance weight and 45 a pin crank-shaped rotation prevention eccentric shaft having the same eccentricity as the drive eccentric shaft. The rotation prevention eccentric shaft 45 is held between the circling scroll and the shaft bearing.

The construction of the scroll teeth of this invention will be explained by referring to FIGS. 5 and 6. If we take a and t as references, then on the base lines A-A' and Y-Y' the circling scroll 34 is constructed of an arc scroll with $R1=a+t/2$, $R1a=R1+K+t$, $R2=R1a+K+t$ and $R3=R2+K+t$ and which has a boss at the center. The fixed scroll 33 has base lines B-B' and Y-Y', and the inner end of the fixed scroll has a seal line defined by $R1=a+t/2$, $R4=R1a-t$ that works with the circling scroll and the remaining portion has the same shape as the circling scroll with $R1a=R1+K+t$, $R2=R1a+K+t$ and $R3=R2+K+t$.

The length a is a basic dimension that is determined by the drive eccentric shaft and the bearing fitted into the boss. The dimension K is an eccentricity of the drive eccentric shaft, and the dimension t represents the thickness of the scroll teeth. The dimension l represents the diameter of circulation motion of the circling scroll, and $l=2K$. FIG. 5 shows the engaged state of the scrolls when the fluid is completely drawn into the sealed spaces 47*a*, 47*b* formed by both the circling and fixed scroll teeth and the upper fulcrum of the circulation diameter.

Next, how the scrolls engage will be explained by referring to FIG. 6.

Figure 6A:
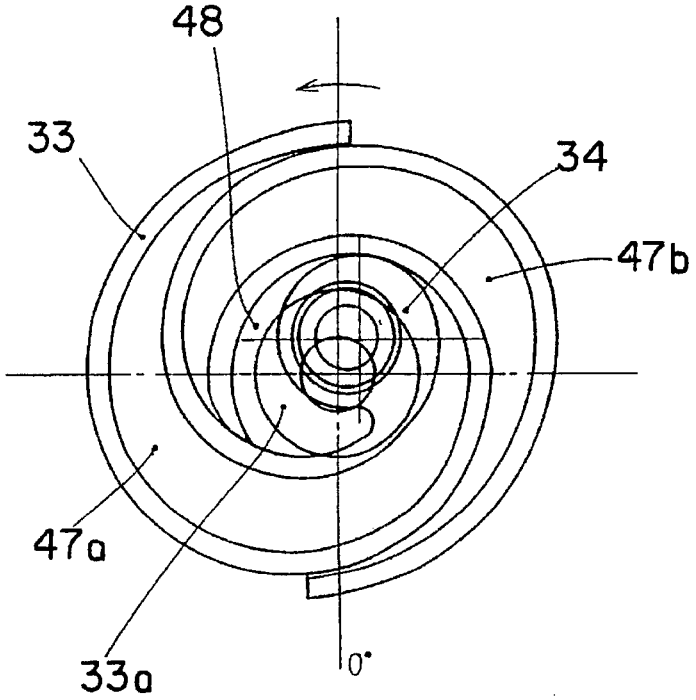
FIGS. 6A to 6D are diagrams showing a compression stroke of the scroll teeth of this invention.

FIG. 6A shows the engaged state of scrolls at 0 degrees, in which if, immediately before the fluid is completely drawn in, the circling scroll is turned in the direction of arrow, the fluid is sealed in the spaces 47*a*, 47*b*. Denoted 48 is the sealed, compressed fluid before the circling scroll is turned. The compressed fluid is supplied from the delivery opening 33*a* in the fixed scroll to where it is used.

Figure 6B:
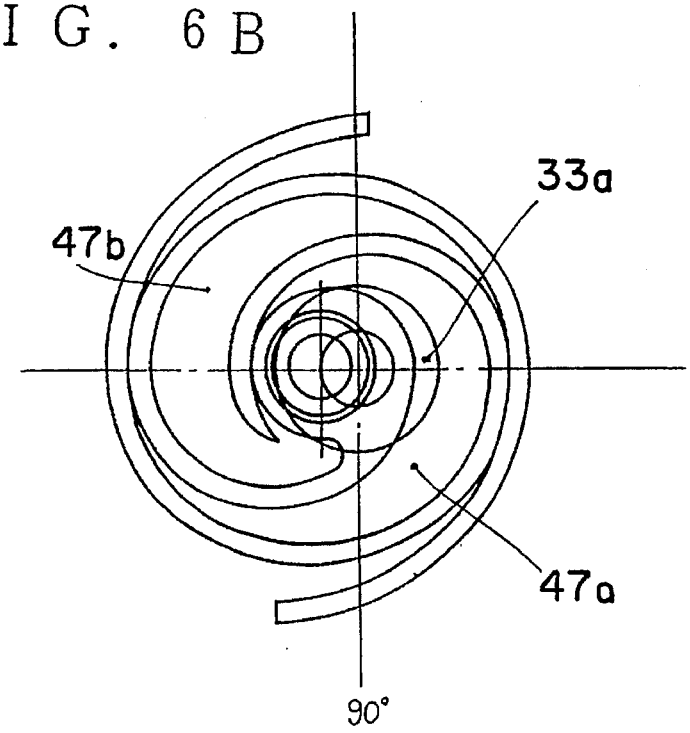

FIG. 6B is the engaged state at 90 degrees, in which the circling scroll has been turned 90 degrees from the state of FIG. 6A. In this state, the fluid sealing spaces 47*a*, 47*b* are compressed and at the same time the scrolls already enter into the delivery stroke from the delivery opening 33*a*.

Figure 6C:
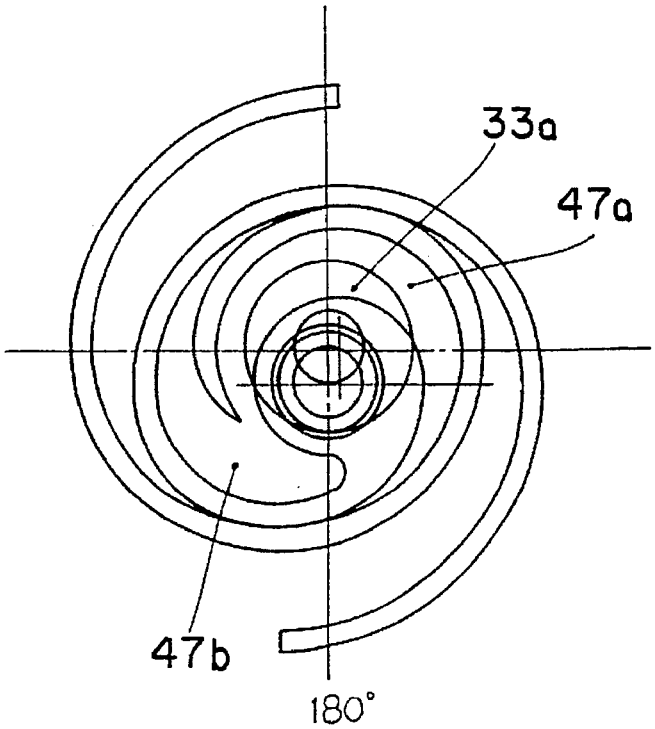

FIG. 6C represents the engaged state at 180 degrees, in which the fluid in the sealing spaces 47*a*, 47*b* is further compressed while being delivered from the delivery opening 33*a*.

Figure 6D:
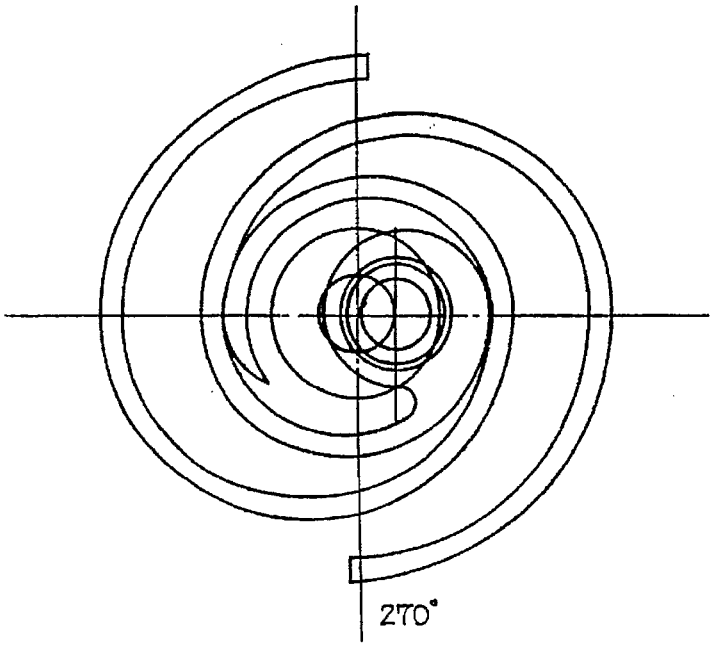
Figure 7:
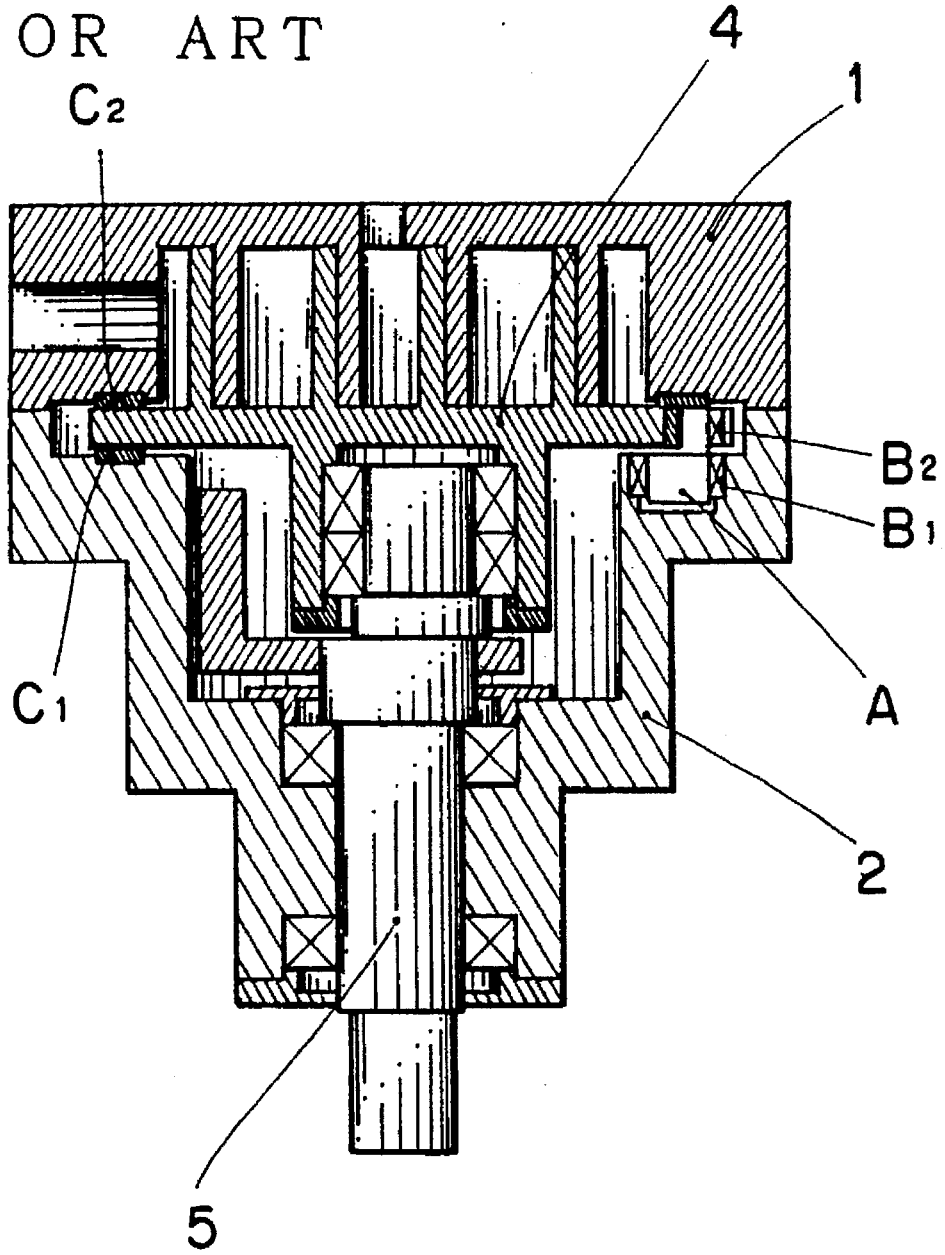
FIG. 7 PRIOR ART
FIG. 7 is a vertical cross section showing a conventional scroll type fluid machine at the pin crank position.
Figure 8:
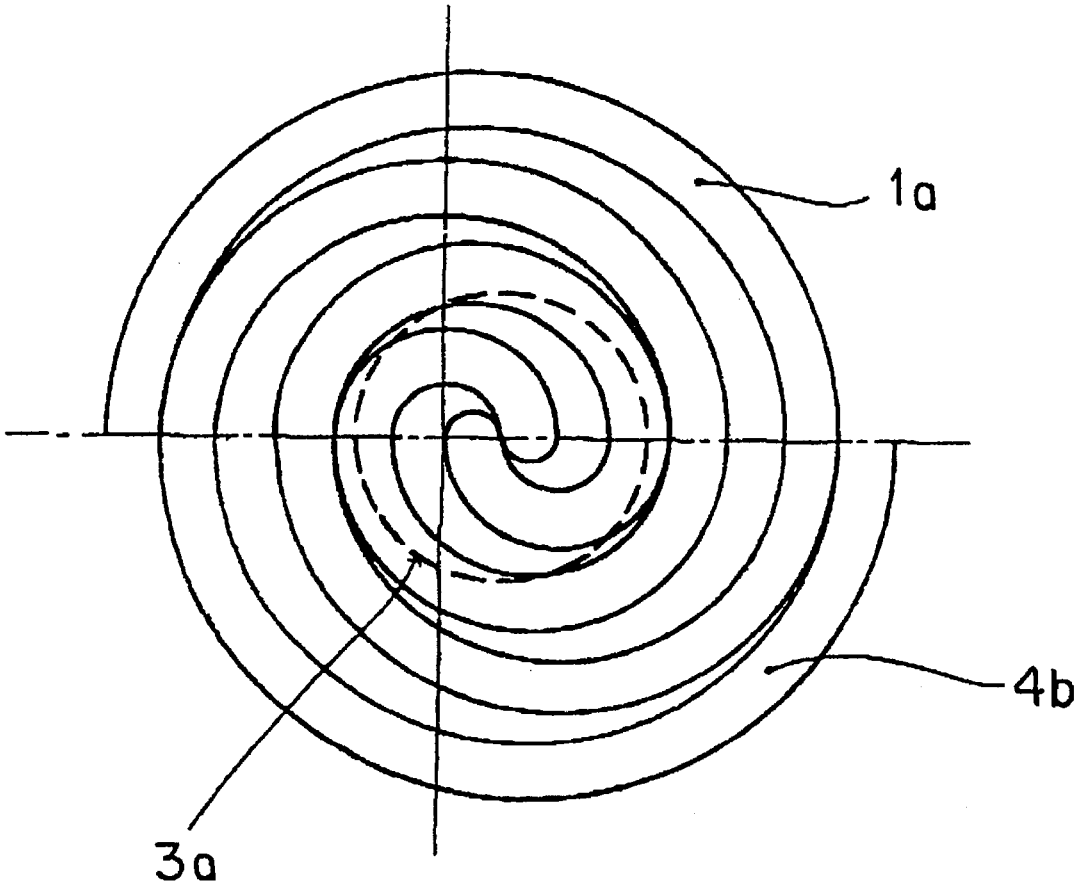
FIG. 8 PRIOR ART
FIG. 8 is a cross section showing the conventional scroll teeth engaged with each other.
Figure 9:
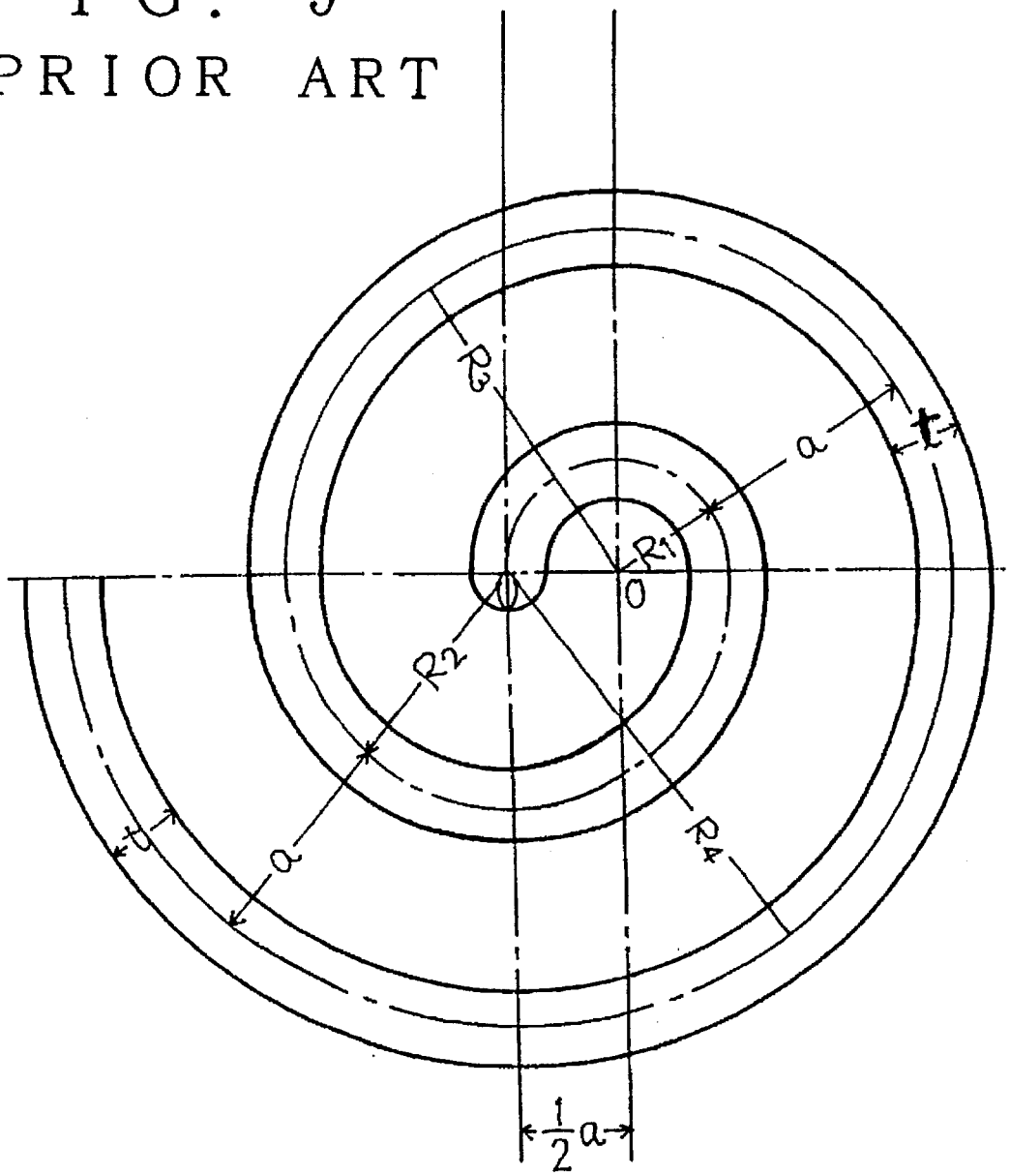
FIG. 9 PRIOR ART
FIG. 9 is a schematic diagram showing the conventional scroll tooth.

FIG. 6D represents the engaged state at 270 degrees, in which the circling scroll has been turned another 90 degrees from the state of FIG. 6C and almost all the fluid has been completely delivered. At the same time, the outer scroll tooth enters the process of forming a new sealing space.

These four diagrams show the sequence of operation of the circling scroll having a boss and the fixed scroll, which has a shape different from the circling scroll and which forms a seal line with a combination of arcs R1 and R4 that works with the boss of the circling scroll. Although the scroll teeth of this embodiment have one turn and a half, which is effective for the blower with low pressure compression ratios, a high compression ratio as required by compressor and vacuum pump can be realized by increasing the number of scroll turns to two or two and a half, thus making it possible to provide a high compression ratio scroll fluid machine with small leakage.

Conventional scrolls have drawbacks, such as defects in engagement, the inability to make the teeth long and to install a bearing at a radial load position, the inability to have the bearing in the both-end supporting configuration, and the inability to lower the cost, simplify the assembly and improve the machining accuracy of the pin crank. The embodiment of this invention shown in FIG. 1 that overcomes these drawbacks has the boss wall 34*b* formed at the scroll boss 34*a* of the circling scroll 34. On the outside of the circling scroll disk at the boss wall 34*b* the drive eccentric shaft 35 is installed through the boss bearings 38 in such a way that it can be rotated. This construction allows the radial load acting from the circling scroll tooth onto the boss to be supported at the load position.

On the fixed scroll side of the boss wall 34*b* of the circling scroll 34 the boss bearing 38 is installed through the pin crank 42 at a position off-centered by a dimension S from the drive eccentric shaft 35. The pin crank base bearing 11 is installed in the frame 31, off-centered by a dimension K in the same eccentric direction as the drive eccentric shaft.

The rotation prevention eccentric shaft 45 is mounted through bearings to the side of the circling scroll and to the bearing cover, off-centered by the same eccentricity as the pin crank.

In this construction, when the drive shaft 35*a* is rotated, the drive eccentric shaft 35 rotates with the K dimension as a radius of rotation. At this time, the boss bearings 38 set the drive eccentric shaft 35 and the circling scroll boss 34*a* free relative to each other. The drive eccentric shaft 35 attempts to rotate the circling scroll 34, but because the pin crank 42 is further off-centered by a dimension S from the drive eccentric shaft 35, the pin crank 42 circles about the pin crank base bearing 41 with the dimension K as a radius. The pin crank 42 is prevented from being rotated and oscillated by the rotation prevention eccentric shaft 45 at two or more supporting points. Hence, as the pin crank 42 circles, the circling scroll 34 circles with a radius of dimension S, rather than rotating about the drive eccentric shaft 35. That is, the compression stroke is carried out by the scroll circling as shown in FIG. 6.

Further, because the pin crank 42 is built into the circling scroll boss 34*a*, the radial load acting on the circling scroll 34 is also borne by this bearing, which means that the circling scroll 34 is supported on both ends. This provides a sufficient support for the circling scroll 34 even when the scroll teeth width is large. Further, the provision of the boss wall 34*b* eliminates the possibility of the delivery pressure leaking to the suction side, thus maintaining a high volume efficiency.

Figure 2:
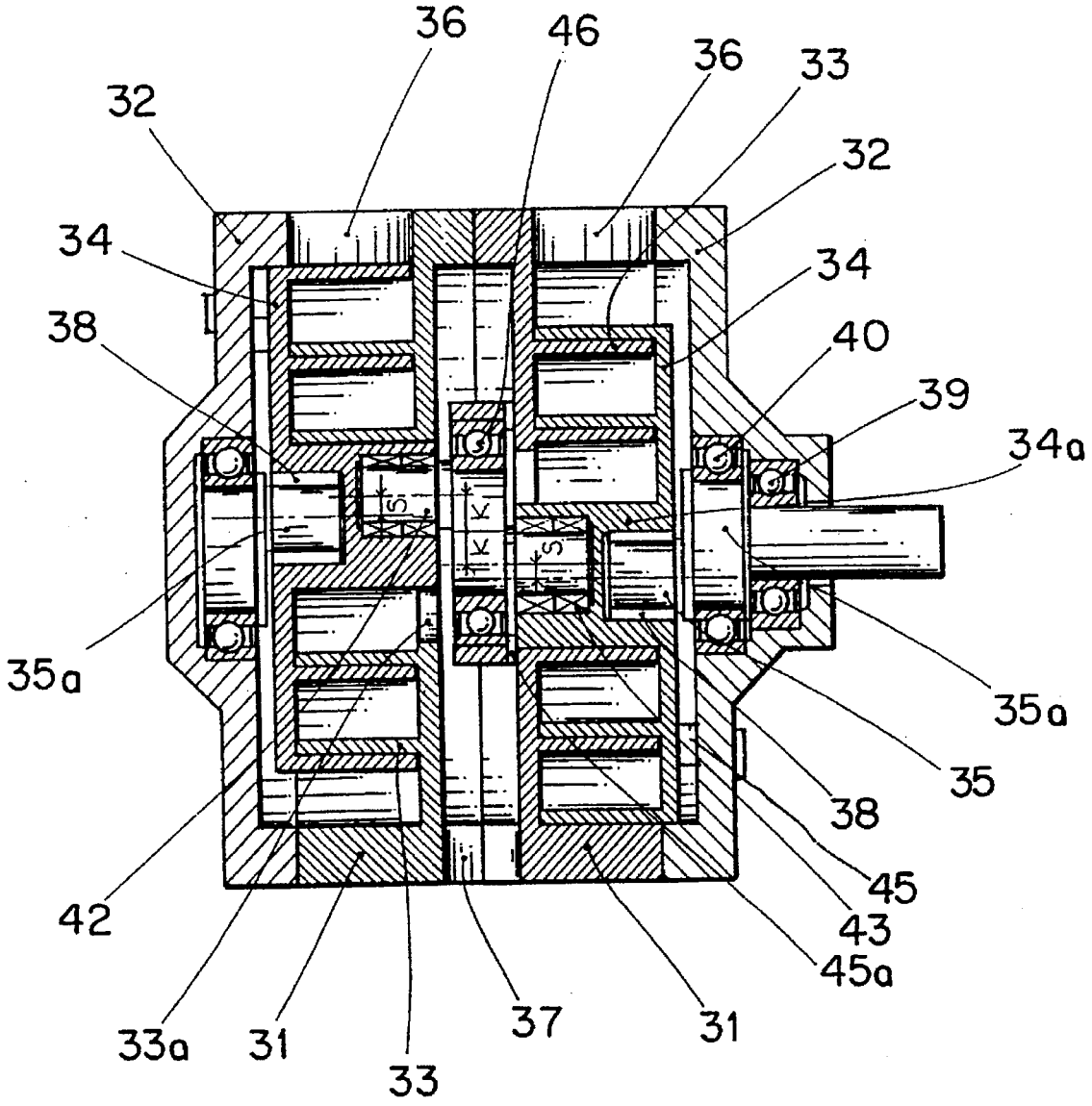
FIG. 2 is a vertical cross section of a composite scroll type fluid machine as one embodiment of this invention.

Next, as shown in FIG. 2, two blocks of scroll compression unit are combined in parallel. The pin crank 42 is shaped like a letter Z and the circling scrolls 34 are set 180 degrees out of phase to left and right and shifted 2K from each other. This construction offers two times the amount of delivery of the one-block type. Because of the circling 180 degrees out of phase, the two blocks completely balance dynamically ensuring smooth and quiet operation.

Figure 3:
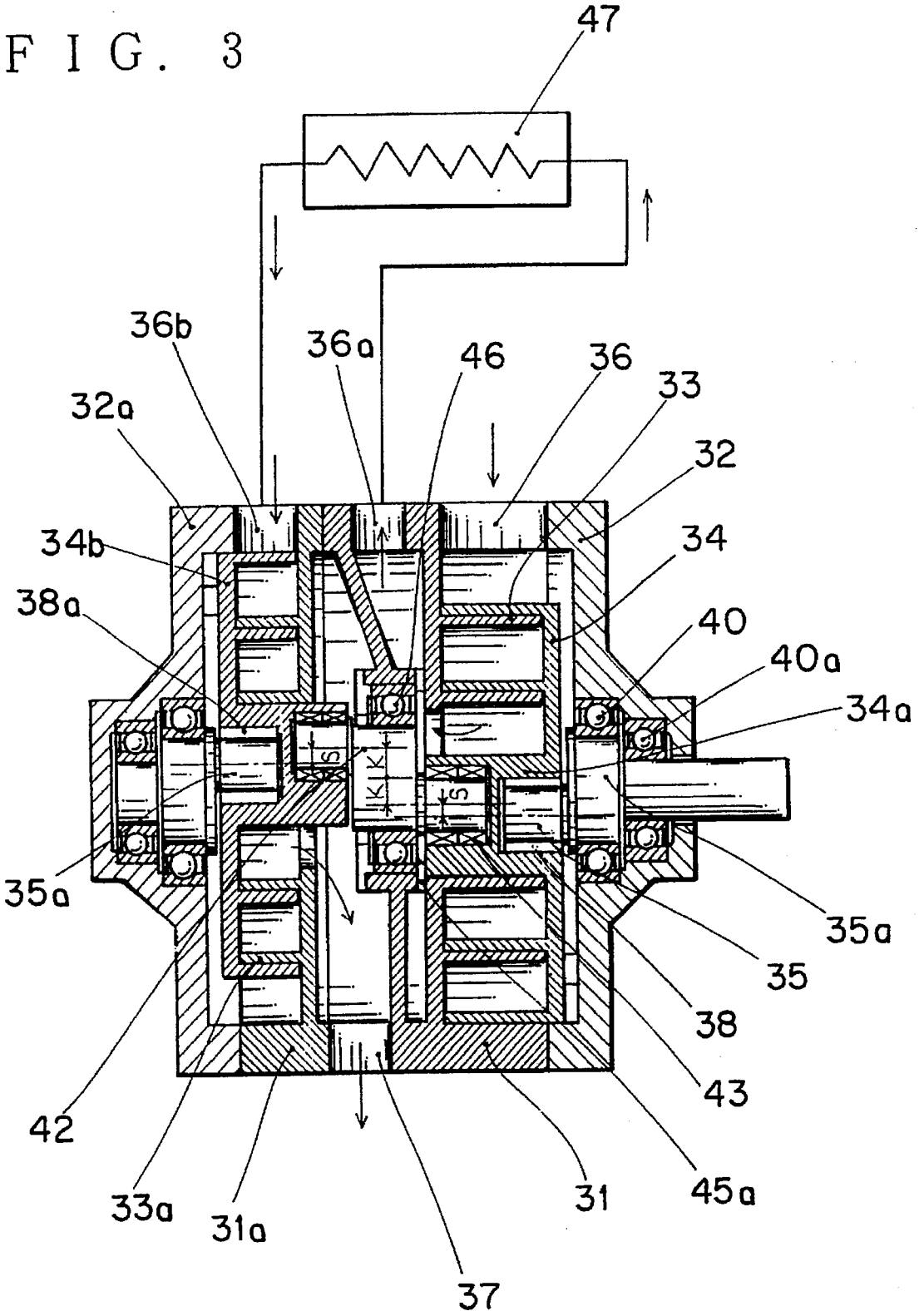
FIG. 3 is a vertical cross section of a two-stage scroll type fluid machine as one embodiment of this invention.

FIG. 3 shows a two-stage type scroll fluid machine that makes use of the features of the two-block parallel operation. The two-stage type is suited for high-pressure compressors and high-vacuum pumps.

The fluid drawn in from a first-stage intake opening 36 flows through a first-stage delivery opening 36*a* and is cooled by an intermediate cooler 47, from which it is again drawn into a second-stage intake opening 36*b* and supplied to a second-stage delivery opening 37. In this way, the fluid is compressed and delivered in two stages. The pin crank 42 is shaped like a letter Z, the scroll block 33, 34 on the side of the right-hand drive eccentric shaft 35 is taken to be a first stage scroll block and the scroll block 33*a*, 34*b* on the left-hand side is taken to be a second stage. The compression ratios of each stage are made equal by adjusting the lengths of scroll teeth of each stage. The high-pressure compressors and vacuum pumps of reciprocal type, root type and two-stage type are complex, large and costly. The construction of this invention makes full use of the features of the scroll fluid machine in reducing the size and cost.

Figure 4:
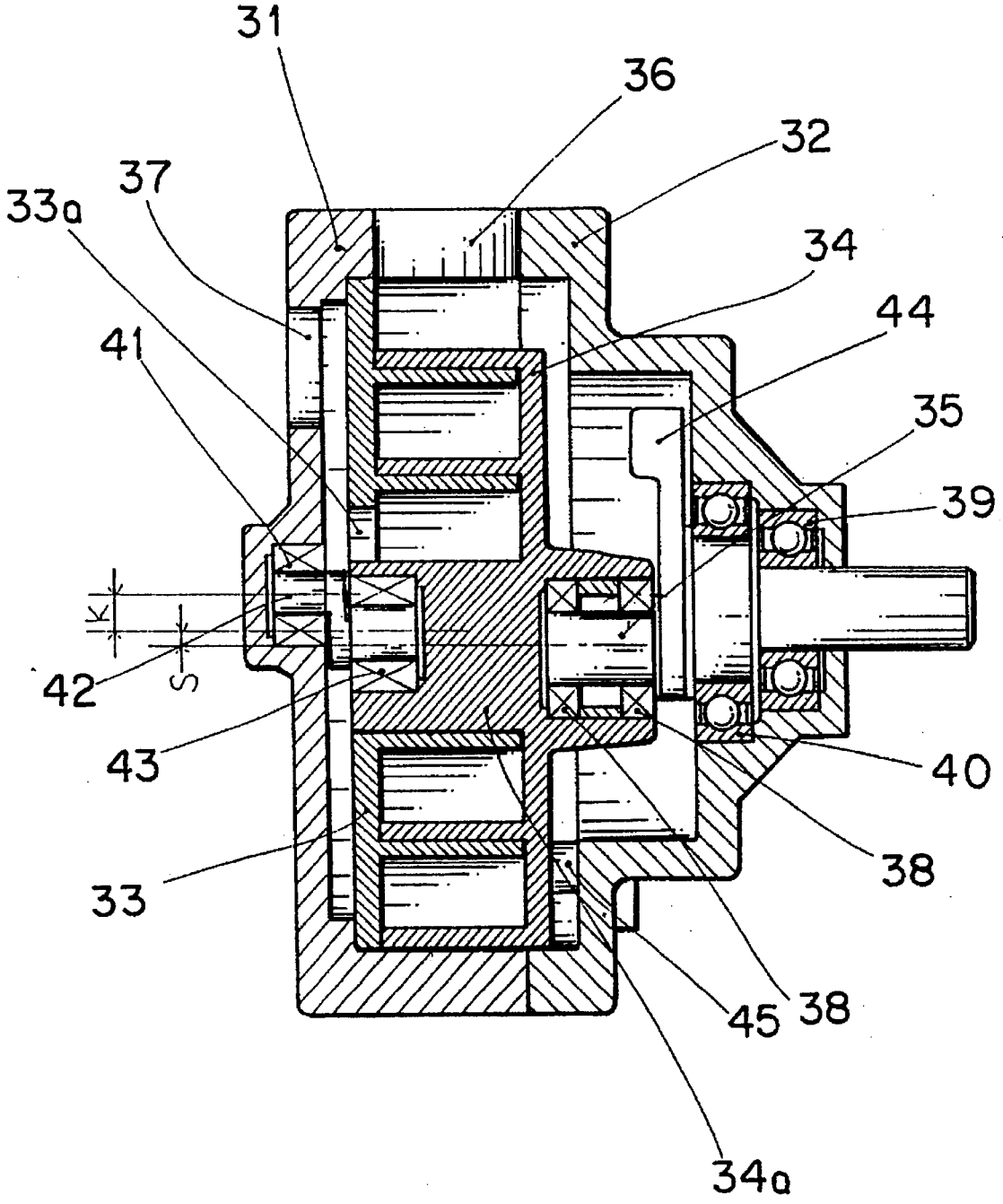
FIG. 4 is a vertical cross section of another embodiment of this invention, which is a conventional scroll type fluid machine provided with a pin crank.

FIG. 4 shows another embodiment of this invention, which is a variation of the conventional scroll fluid machine with a cantilever bearing. That is, the boss 34*a* of the circling scroll 34 is supported at the left end by the pin crank 42. The circling scroll boss 34*a* performing the circling motion, therefore, is supported by bearings at both sides, improving the circling accuracy and allowing the scroll teeth length to be extended and the capacity to be increased.

As to the shape of scroll, the dimension a of the circling scroll boss can be freely determined according to the size of the drive eccentric shaft and the bearing installed, and the scroll teeth is configured with a series of continuous arcs that can be chosen according to the pressure used. The internal end of the fixed scroll has a sealing shape that matches the oscillating motion of the circling scroll, thus providing a high level of sealing of fluid.

The advantages of these embodiments may be summarized as follows.

(1) Because the circling scroll is provided with a boss, the radial load acting on the circling scroll tooth can be borne at the load position. This allows a rational selection of the boss bearing and enables the drive shaft to be made short.

(2) Because the pin crank is used at the boss of the circling scroll, the circling scroll can be supported on both sides, allowing the use of smaller bearings. This in turn simplifies machining and assembly works and lowers the cost.

(3) Because the circling scroll is supported on both sides, there are no deviations in the circling motion of the scroll, allowing the scroll length to be elongated.

(4) By forming the pin crank in the shape of letter Z for use on both sides, as shown in FIGS. 2 and 3, two blocks of scroll unit can be combined to increase the capacity. The scrolls may also be connected in series in two stages to provide a compact high compression structure that has not been feasible so far.

If bearings of grease-sealed type are used in this invention, it is possible to provide an oil-free scroll type fluid machine by forming a fine gap in the engagement between the scroll teeth.

Figure 10:
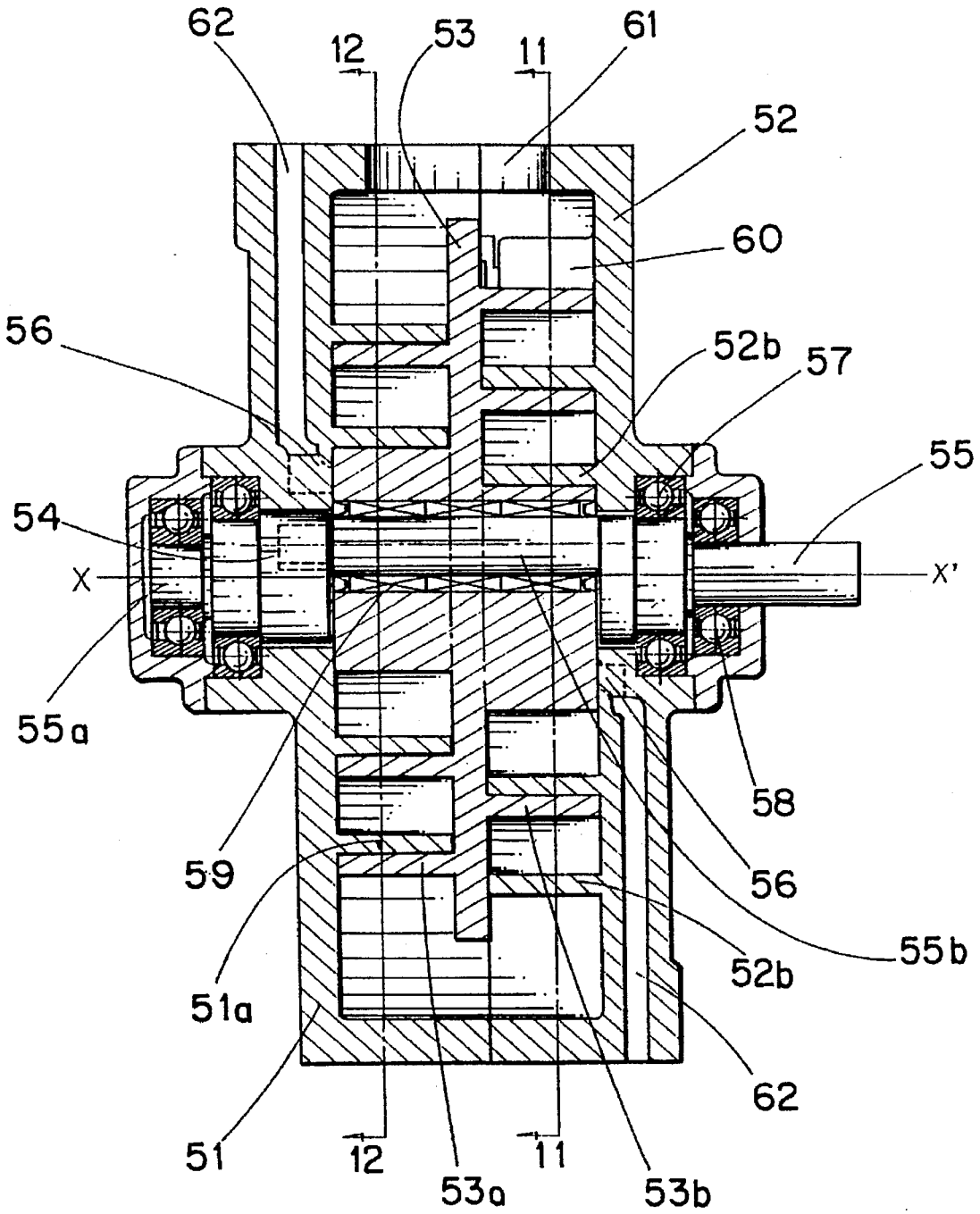
FIG. 10 is a vertical cross section of an embodiment of this invention.
Figure 11:
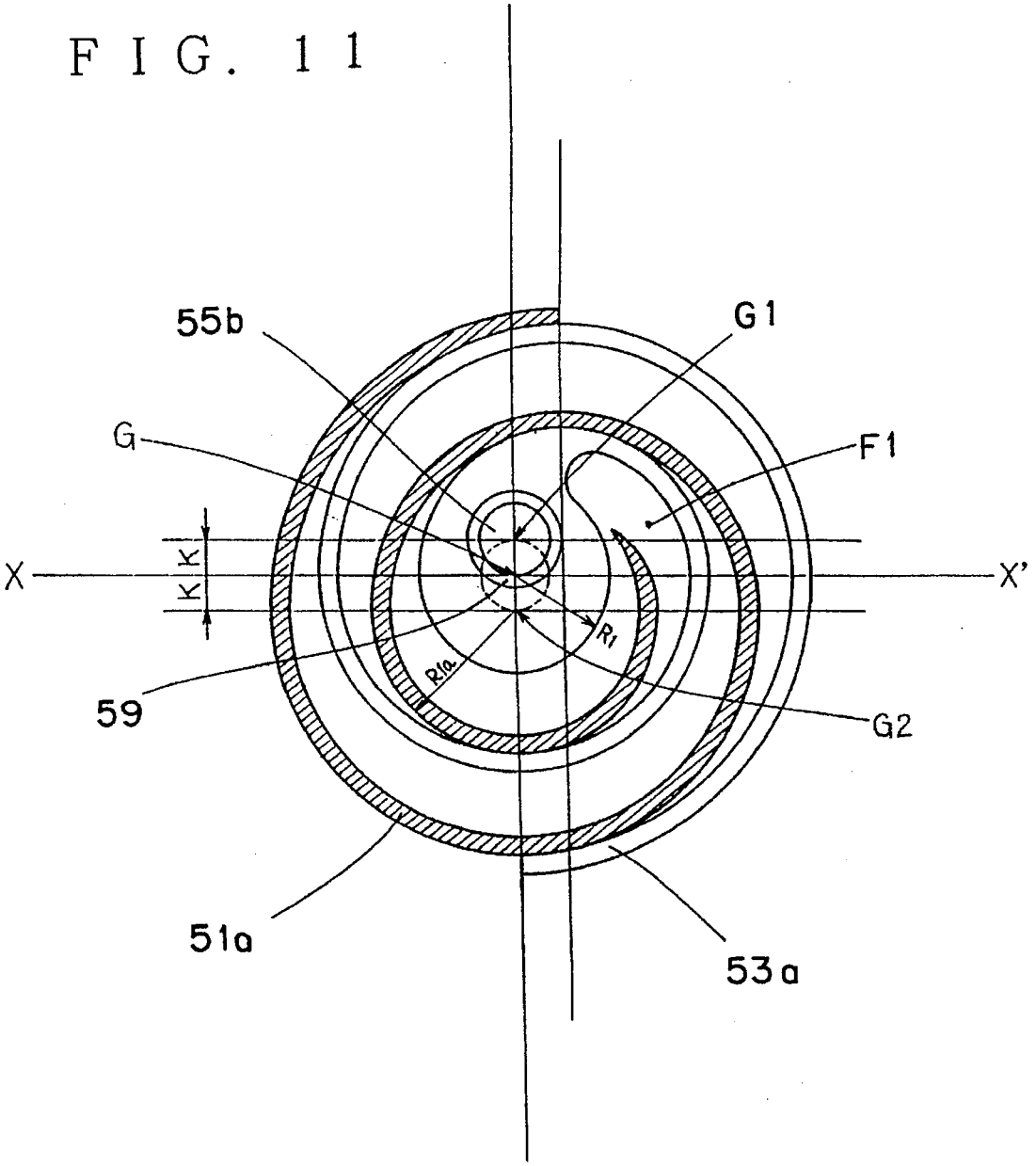
FIG. 11 is a schematic diagram showing a lap construction of the left scroll tooth in a twin scroll type fluid machine of this invention.
Figure 12:
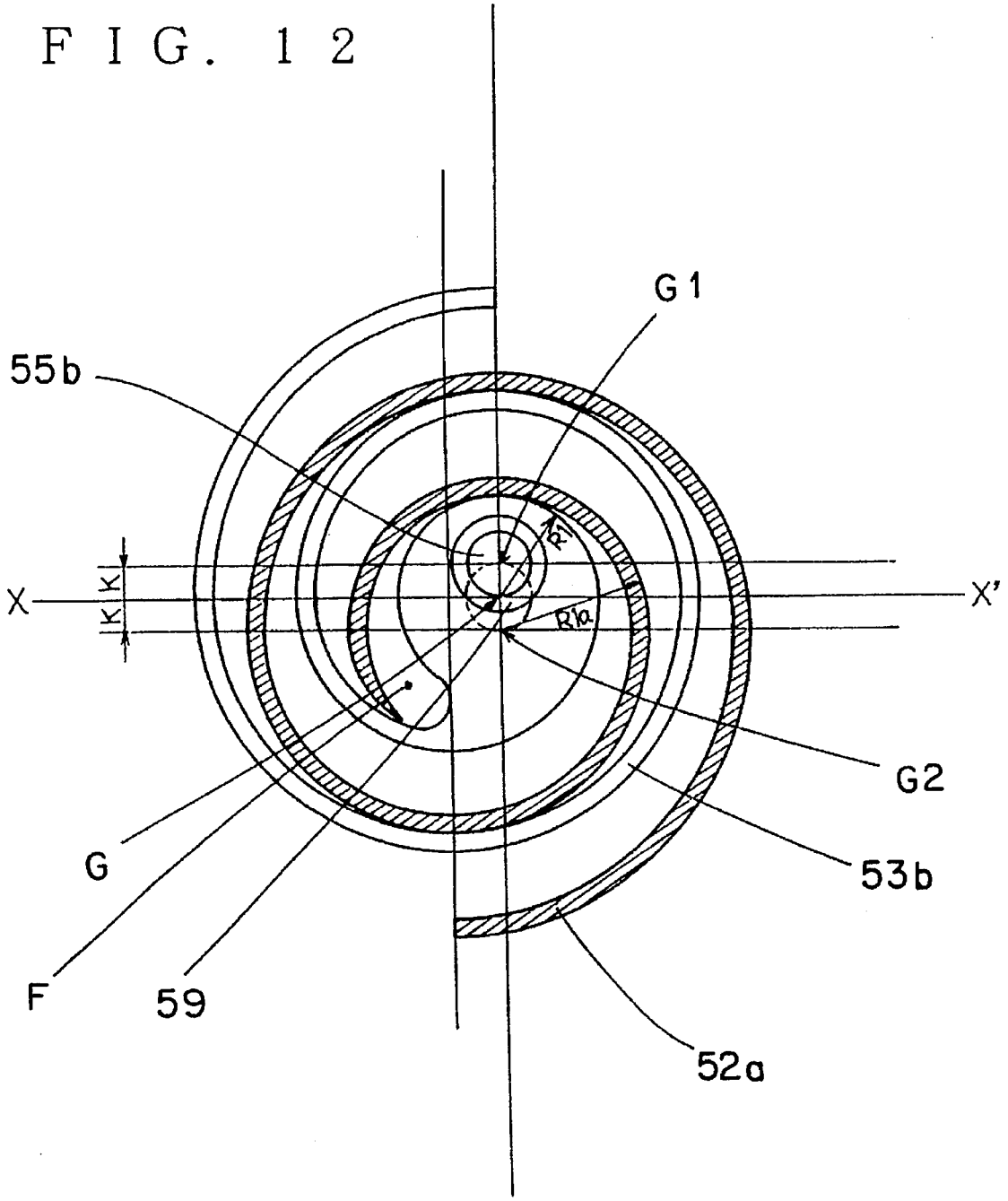
FIG. 12 is a schematic diagram showing a lap construction of the right scroll tooth in a twin scroll type fluid machine of this invention.
Figure 13:
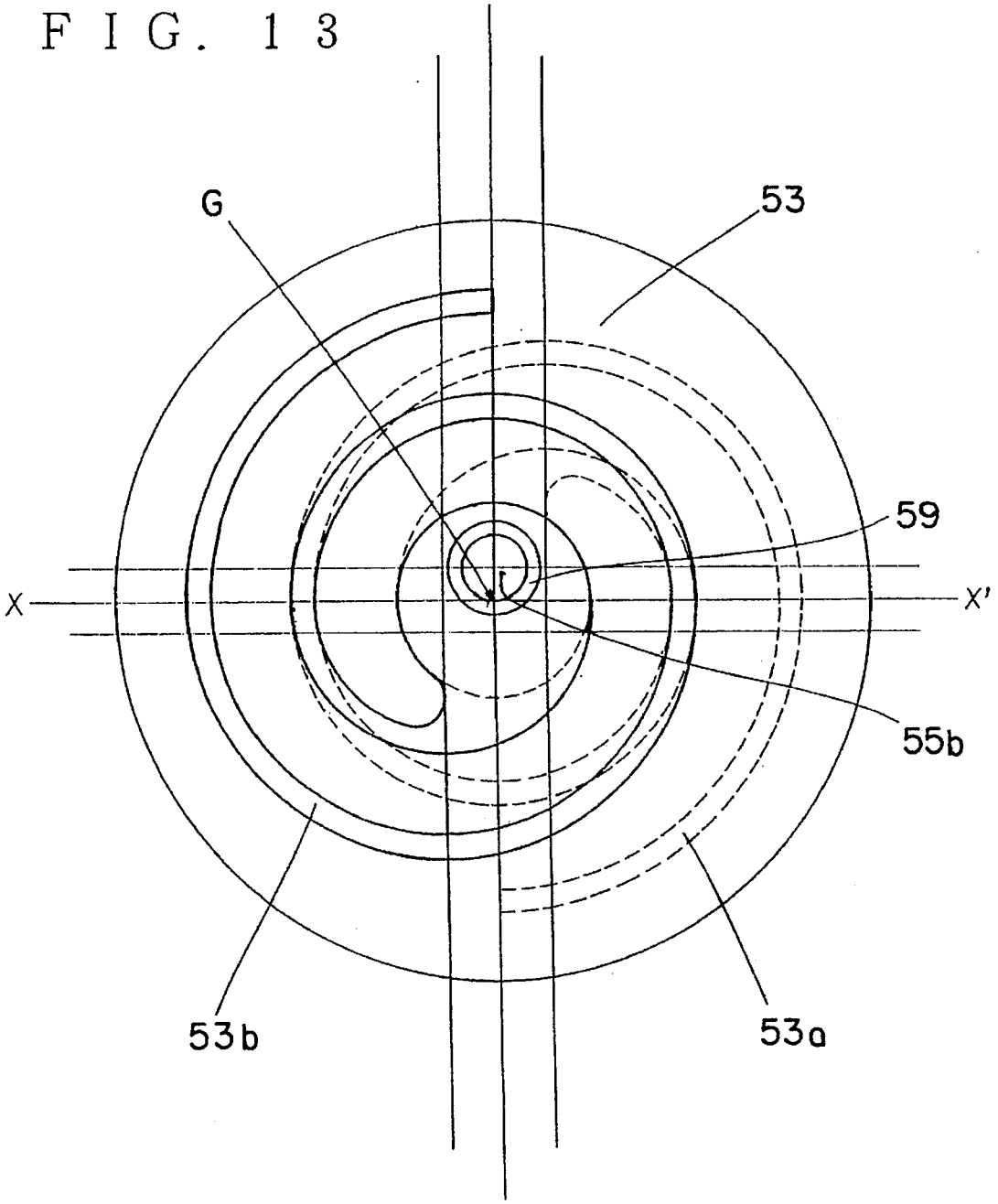
FIG. 13 is a schematic diagram showing a circling scroll construction as an embodiment of this invention.

Further embodiments of this invention are described by referring to FIGS. 10 to 14. Reference numeral 51 represents a left frame which accommodates bearings that support a subshaft 55*a*. The subshaft 55*a* is aligned with a drive shaft 55 and receives a drive eccentric shaft 55*b*. Designated 52 is a right frame which accommodates bearings 57, 58 to support the drive shaft 55. Denoted 53 is a mirror disk of a circling scroll having scroll teeth 53*a*, 53*b* on both sides. The scroll teeth 53*a*, 53*b* are positioned 180 degrees out of phase about the drive shaft 55 to achieve a weight balance between them. FIG. 13 shows the position of the scroll tooth of the circling scroll. Denoted 54 is a key that securely and accurately fixes the engagement between the drive eccentric shaft 55*b* and the subshaft 55*a*. A delivery port 56 is provided to each of the left and right scroll teeth. Bearings 59 for the circling scroll are mounted rotatable. A plurality of pin cranks 60 are provided along the outer circumference of the circling scroll to prevent rotation of the scroll. The pin cranks 60 are off-centered by the same eccentricity as the drive eccentric shaft 55*b*. Denoted 61 is an intake port and 62 a delivery port. Symbol 51*a* signifies a fixed scroll tooth provided to the left frame, and 52*b* a fixed scroll tooth provided to the right frame. Thus 51*a* and 52*b*, as best seen in FIG. 10, are the respective stationary scrolls (referred to as scroll "teeth" elsewhere) on opposite sides of the mirror disk 53, and are formed on the inside of frame 51.

The construction of balance type scroll teeth of this invention will be described by referring to FIGS. 11, 12 and 13. FIG. 11 shows a cross section of the scroll teeth lap configuration taken along the line 12—12 of FIG. 10. FIG. 12 shows a cross section of the scroll teeth lap configuration taken along the line 11—11 of FIG. 10. FIG. 13 shows the circling scroll as seen from the direction of the drive shaft 55, with X-X' representing the drive shaft axis and G representing the center.

Now, the engagement of the scroll 51*a* teeth 53*a* is explained.

FIG. 11 shows the engagement between the fixed scroll of the left frame and the left tooth of the circling scroll 53, with the center of the drive eccentric shaft 55*b* located at the center G1 that is off-centered by the eccentricity K from the drive shaft axis X-X'. G represents the center of the circling scroll, which has a boss with a radius of R1. The configuration of this scroll teeth conforms to that of the scroll type fluid machine of Japan Patent Application No. Heisei 6-169906, filed on Jun. 17, 1994. The fixed scroll 51*a* of the left frame that engages with the left tooth 53*a* of the circling scroll 53 has its center G2 located below the axis X-X' and is downwardly off-centered by the same eccentricity K from the drive shaft axis X-X' and is defined by an arc having a radius R1*a* about the center G2. They engage as shown in FIG. 11. The following relation holds: R1a=R1+K+t.

FIG. 12 shows the engagement between the fixed scroll 52 of the right frame and the right tooth of the circling scroll, with the center of the drive eccentric shaft 55*b* located at the center G1 that is off-centered upwardly by the eccentricity K from the drive shaft axis X-X'.

G represents the center of the circling scroll 53. The boss of the right tooth 53*b* has a radius of R1. As seen in FIG. 11, the end of right tooth 53*b* is shown directly above and diametrally opposite the end of the left tooth 53*a*, best seen in FIG. 12. The configuration of the right tooth basically conforms to that defined in Japan Patent Application No. Heisei 6-169906 filed on Jun. 17, 1994.

The fixed scroll 52*b* of the right frame that engages with the right tooth 53*b* of the circling scroll 53 has its center G2 off-centered in a direction opposite to that of the fixed scroll of the left frame by the same eccentricity K from the drive shaft axis and is defined by an arc having a radius R1*a* about the center G2. It is noted that the fixed scroll of the right frame is formed in the upward direction and engages as shown in FIG. 12. The following relation holds: R1a=R1+K+t. The configuration of the fixed scroll of the right frame conforms to that defined in Japan Patent Application No. Heisei 6-169906 filed on Jun. 17, 1994.

FIG. 13 shows the configuration of the circling scroll 53 as seen from the direction of the drive shaft 55, with the solid line 53*b* representing the right scroll tooth and the dashed line 53*a* representing the left scroll tooth. When the circling scroll 53 is divided by an arbitrary line passing through the center G, the divided halves completely balance each other in weight.

Figure 14:
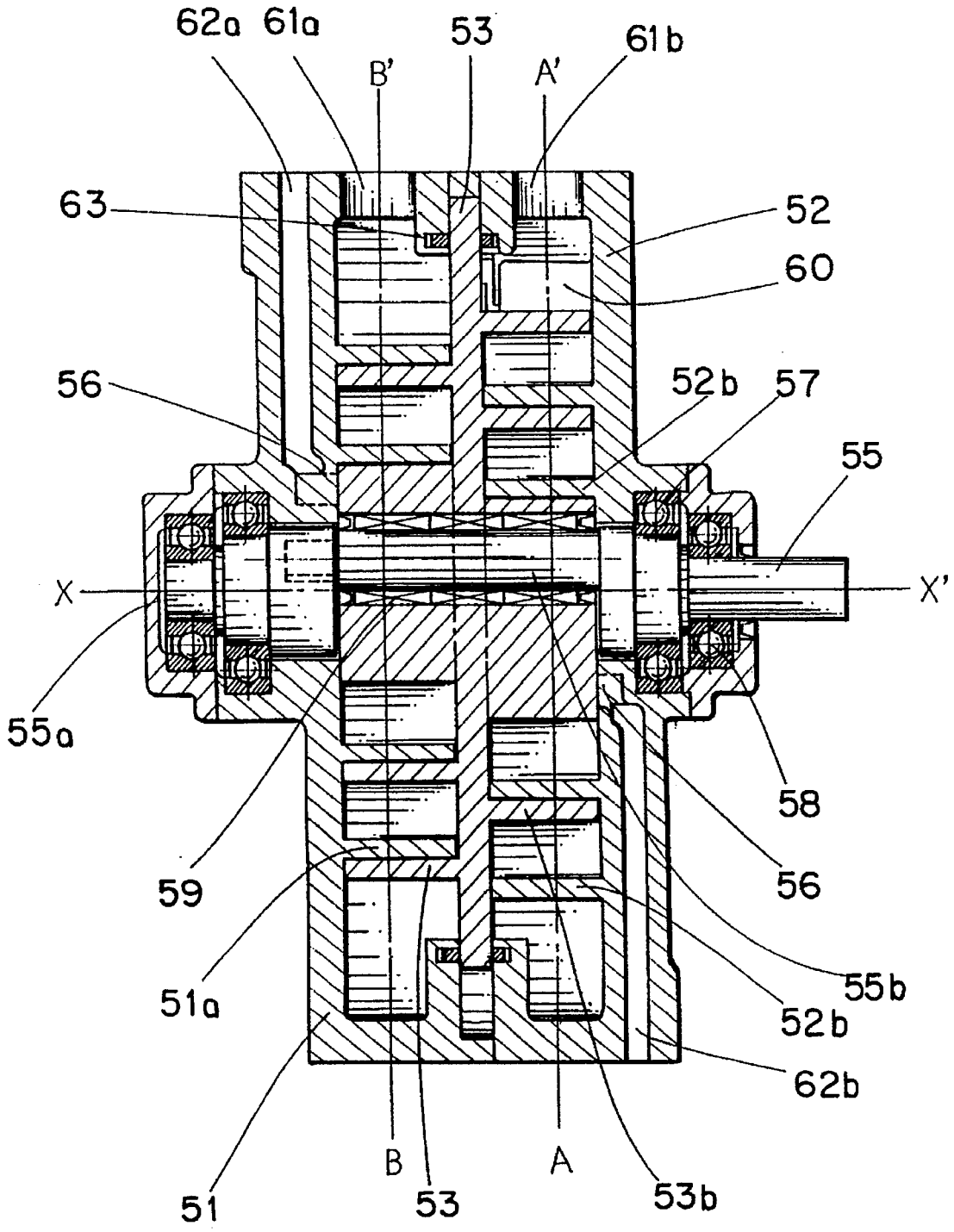
FIG. 14 is a vertical cross section of a composite type scroll type fluid machine as an embodiment of this invention.
Figure 15:
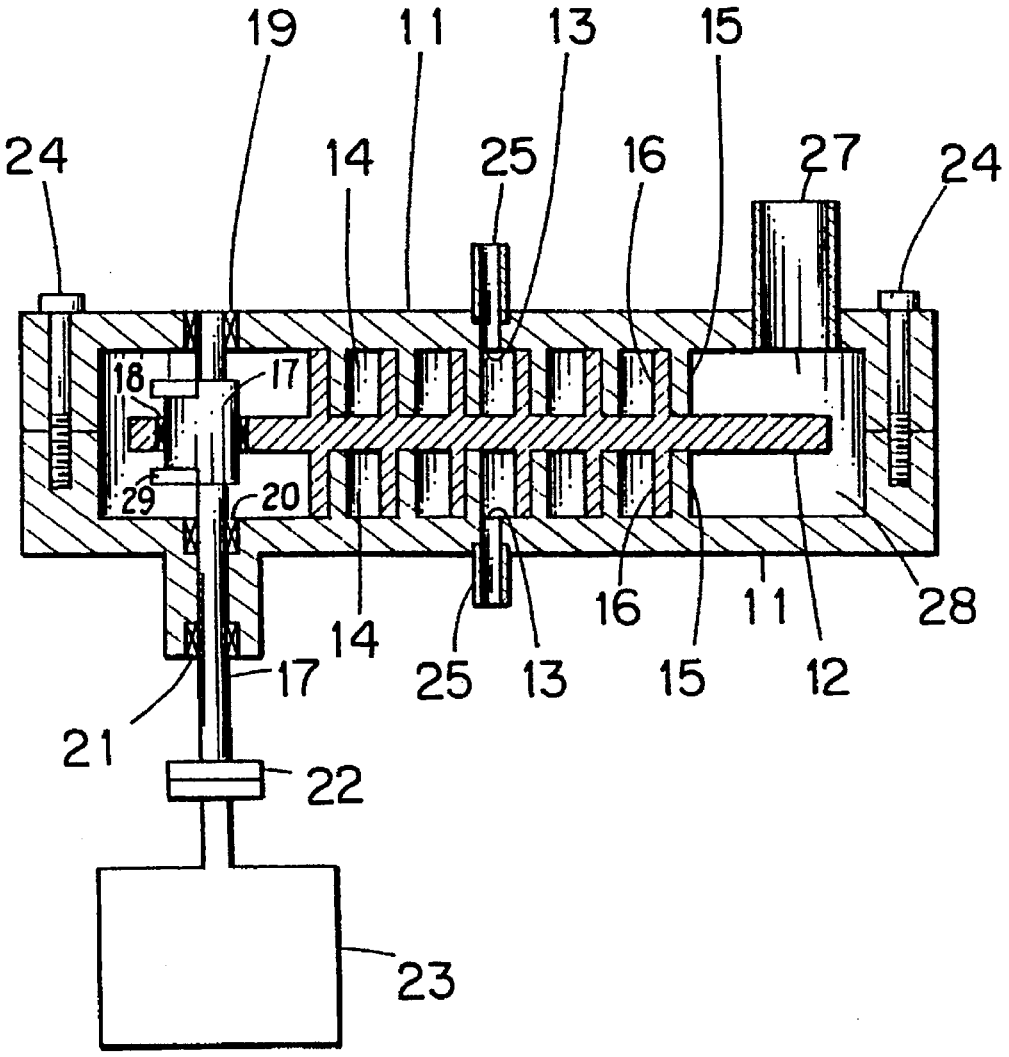
FIG. 15 PRIOR ART
FIG. 15 is a schematic cross section showing the construction of a conventional twin type scroll.

Next, as shown in FIG. 14, seals 63 are provided on both sides of the mirror disk of the circling scroll along the outer circumference at the contacting positions in order to form a two-way compression mechanism with suction ports 61*a*, 61*b*. This construction allows each scroll tooth to be used for different purposes. For example, one scroll tooth may be used as a compressor while the other is used as a vacuum pump.

As shown in FIGS. 10 to 13, the circling scroll 53 has a left scroll tooth and a right scroll tooth separated from each other by the mirror disk and arranged 180 degrees out of phase. In the state of engagement in which the left scroll tooth has completely drawn in a fluid, as shown in FIG. 11, the right scroll tooth of FIG. 12 is leading the left scroll tooth by 180 degrees in the compression stroke and the space F of FIG. 12 is in the delivery stroke. At this moment, the space F1 of FIG. 11 is in the compression stroke.

The conventional twin type has the left and right scroll teeth operate in the same strokes so that the spaces F both enter the delivery stroke at the same time. With the construction of this invention, however, the left and right scroll teeth alternately enter the suction stroke or delivery stroke, reducing the pulsation to half.

The advantages of these embodiments may be summarized as follows.

(1) The circling scroll is formed as a twin type, in which left and right scroll teeth balance each other, so that there is no need to provide a balance weight, ensuring low vibration and high revolution.

(2) Because a complete balance is established between the left and right circling scroll teeth in the balance type twin scroll, it is possible to have a large eccentricity and therefore allow the manufacture of a scroll fluid machine of large capacity.

(3) A two-way compression mechanism can be formed, which consists of left and right circling scrolls on both sides of the center mirror disk of the circling scroll. It is therefore possible to use the single machine for different purposes, i.e., as a compressor and a vacuum pump.

(4) The twin type circling scroll has two circling scroll teeth arranged 180 degrees out of phase with each other. This arrangement reduces the suction and delivery pulsations to one-half the magnitude of the conventional twin type. Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A balance type scroll fluid machine, comprising:

a central mirror disk of a circling scroll, having two sides and mounted to circle through a bearing rotatably provided about an eccentric drive shaft, the mirror disk having scroll teeth on each of said two sides, said scroll teeth on each of said two sides having the same configuration and each of said two sides having a respective boss at a central portion, the scroll teeth on one of said two sides being positioned 180° out of phase relative to the scroll teeth on the other of said two sides about a drive shaft axis in order to achieve a weight balance therebetween; and fixed scrolls located on opposite sides of said mirror disk, each fixed scroll having scroll teeth respectively engaged with corresponding scroll teeth on an adjacent one of said two sides of the mirror disk, one of said scroll teeth of the fixed scrolls having an arcuate shape with an end located above a center point thereof (G2) which is downwardly off-centered relative to said drive shaft axis by an eccentricity which is the same as an eccentricity of the eccentric drive shaft of said mirror disk relative to said drive shaft axis, the other of said scroll teeth of the fixed scrolls having an arcuate shape with an end located below said center point (G2), whereby the ends of said one scroll tooth and said other scroll tooth of the fixed scrolls, disposed cooperatively on said opposite sides of said mirror disk alternately perform compression operations separated by 180°.

* * * * *